US005292258A

United States Patent [19]

Sakurai

[11] Patent Number: 5,292,258

[45] Date of Patent: Mar. 8, 1994

[54] CONNECTOR ASSEMBLY'S LOCKING MECHANISM

[75] Inventor: Kazuaki Sakurai, Shizuoka, Japan

[73] Assignee: Yazaki Corporation, Tokyo, Japan

[21] Appl. No.: 55,366

[22] Filed: May 3, 1993

[30] Foreign Application Priority Data

May 8, 1992 [JP] Japan ..... 4-115951

[51] Int. Cl.[5] ..... H01R 13/627

[52] U.S. Cl. ..... 439/352; 439/353

[58] Field of Search ..... 439/350, 351, 352, 353, 439/354, 357, 358

[56] References Cited

U.S. PATENT DOCUMENTS

| | | | |
|---|---|---|---|
| 4,370,013 | 1/1983 | Niitsu et al. | 439/352 |
| 4,634,204 | 1/1987 | Detter et al. | 439/352 |
| 4,984,994 | 1/1991 | Duncan et al. | 439/352 |
| 5,199,902 | 4/1993 | Kahle et al. | 439/352 |

FOREIGN PATENT DOCUMENTS 62-184677 5/1986 Japan .

*Primary Examiner*—Larry I. Schwartz
*Assistant Examiner*—Hien D. Vu
*Attorney, Agent, or Firm*—Sughrue, Mion, Zinn, Macpeak & Seas

[57] ABSTRACT

Disclosure is a locking mechanism for connectors which are engaged with each other, which prevents the connectors from being insufficiently engaged by inertial locking, and allows the connectors to be engaged or disengaged with ease. The locking mechanism for male and female electrical connectors which are engaged with each others, a guide frame mounted on the upper wall of a male connector housing includes a slide piece which is slidably provided between the upper wall and the guide frame, and a locking spring. One end portion of the locking spring is fixedly secured to the guide frame, and the other end portion is positioned above the front end portion of the slide piece when the latter is at the forward position, and in front of the front end portion when the slide piece is at the backward position. The locking section of the male connector housing and the engaging section of the slide piece hold the slide piece in position. The female connector housing has a connector receiving section. When the two connector housings are engaged with each other, the locking spring is brought in slide contact with the protrusion formed at the connector receiving section.

2 Claims, 4 Drawing Sheets

CONNECTOR ASSEMBLY'S LOCKING MECHANISM

BACKGROUND OF THE INVENTION

1. Field of the Industrial Application

This invention relates to the locking mechanism of a connector assembly through which electrical wires, for instance, in an automobile are connected.

2. Description of the Prior Art

FIG. 7 (A) is a longitudinal sectional view showing a conventional connector housing locking mechanism, and FIG. 7 (B) is a perspective view of a locking spring employed in the locking mechanism.

As shown in FIGS. 7 (A) and (B), the locking spring d has a locking hole a at the middle, and both end portions are bent in the opposite directions, thus providing a pair of bent portions b and c. That is, the locking spring is substantially S-shaped in section. The bend portion c is fitted in a locking groove f formed in the outer side wall of a male housing g. An engaging protrusion h is extended inwardly from the outer edge of the side wall of a female connector housing g. The engaging protrusion h and the locking hole a of the locking spring d form engaging means (cf. Japanese Unexamined Utility Model Application No. 184677/1987).

The conventional connector housing locking mechanism is designed as described above. Therefore, when the male connector housing e is inserted into the female housing g, the locking spring d of the male connector housing is pushed downwardly sliding on the slope h' of the above-described engaging protrusion h, and finally when the male connector housing e has been fully inserted into the female connector housing g, the locking hole a of the locking spring d, being moved upwardly by the elastic force of the locking spring d, is engaged with the engaging protrusion h. Thus, the male connector housing e has been fixedly engaged with the female connector housing g.

The male connector housing e can be disengaged from the female connector housing g as follows: While the bent portion b of the locking spring d is being pushed downwardly to disengage the engaging protrusion h from the locking hole a, the male connector housing e is pulled out of the female connector housing g.

That is, in the conventional connector housing locking mechanism, the locking spring made of metal is employed as a component to provide a great housing locking force. That is, the conventional connector housing locking mechanism is advantageous in that it has such a great housing locking force; however, this means that it needs a great force to disengage the male connector housing from the female connector housing (by depressing the bent portion b of the locking spring d).

In general, in engagement of a male connector and a female connector, the relationships between the terminal engaging force and the connector engaging stroke are as indicated in FIG. 8 (A), in which the Y-axis represents housing locking forces, while the X-axis represents connector engaging strokes. As is apparent from the graphical representation, the housing locking force p reaches its peak with a connector engaging stroke $x_1$, and the terminal engaging force q reaches its peak with a connector engaging stroke $x_2$.

Therefore, an inertial locking force r, which is formed by combining the housing locking force p and the terminal engaging force q, first reaches a large peak with the connector engaging stroke $x_1$, and next a small peak with the connector engaging stroke $x_2$ as shown in FIG. 8 (B), in which the X'-axis represents connector strokes, and the Y'-axis represent housing locking forces.

As is apparent from the graphical representation of FIG. 8 (B), the inertial locking force must be greater than the terminal engaging force. As the number of terminals in the connector is increased, this tendency is strengthened, so that the connector engaging force is increased accordingly, and at the same time, the connector disengaging force is also increased. Thus, it gets increasingly difficult to perform a connector engaging or disengaging operation.

SUMMARY OF THE INVENTION

In view of the foregoing, an object of this invention is to provide a locking mechanism for connectors through which electrical wires are connected, for instance, in an automobile, which prevents the connectors from being insufficiently engaged by inertial locking, and allows the connectors to be engaged or disengaged with ease.

The foregoing object of this invention has been achieved by the provision of a locking mechanism for a connector assembly comprising a pair of male and female connectors which are engaged with each other wherein, a guide frame is mounted on the outer wall of the housing of one of the connectors, the guide frame having a locking spring substantially inverted-V-shaped in section one end portion of which is fixedly secured thereto, a slide piece is set between the guide frame and the outer wall of the housing in such a manner that the slide piece is slidable in the direction of engagement of the connectors, locking means for holding the slide piece at a forward position and at a backward position is provided between the slide piece and the outer wall of the housing, the housing of the other connector has a connector receiving section for receiving the housing of the one connector, the connector receiving section has a spring check which is engageable with the locking spring, when the slide piece is at the forward position, the free end of the locking spring is positioned on the front end portion of the slide piece, whereas when the slide piece is at the backward position, the free end of the locking spring is positioned in front of the front end portion of the slide piece, and with the slide piece at the backward position, the housings of the connectors are disengaged with each other.

The locking mechanism of the invention is designed as described above. Hence, in the case where the two connectors are engaged with each other, the locking spring is held at both ends, thus providing a great locking force; and in the case where the connectors are disengaged from each other, before the disengagement the slide piece is moved backwardly, so that the locking spring is cantilevered, whereby the disengaging force can be reduced.

BRIEF DESCRIPTION OF THE DRAWINGS

FIG. 4 (B) is a longitudinal sectional view showing the connectors which have been fully engaged;

FIG. 6 (B) is a longitudinal sectional view showing the connectors which have been fully disengaged from each other;

FIG. 7 (B) is a perspective view of a locking spring in the locking mechanism.

FIG. 8 (B) is also a graphical representation indicating inertial locking forces with connector engaging strokes.

DETAILED DESCRIPTION OF THE PREFERREED EMBODIMENT

Figure 1:
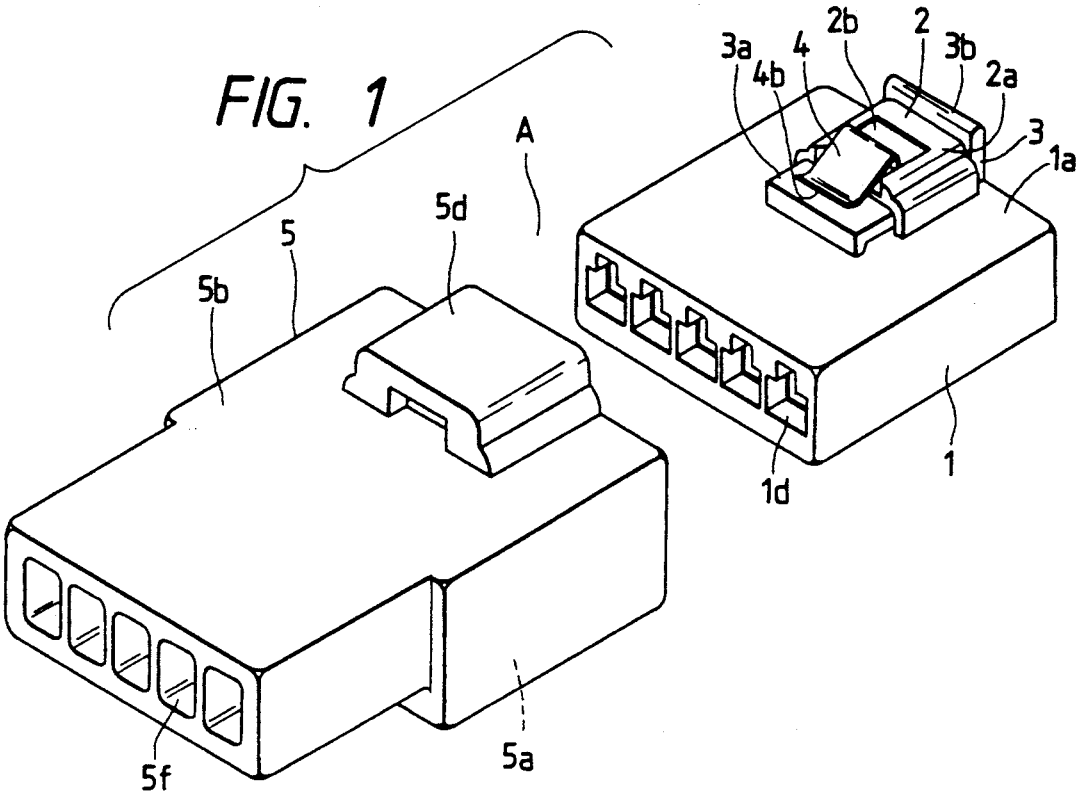
FIG. 1 is an exploded perspective view showing a connector assembly A with a connector housing locking mechanism according to this invention.
Figure 2:
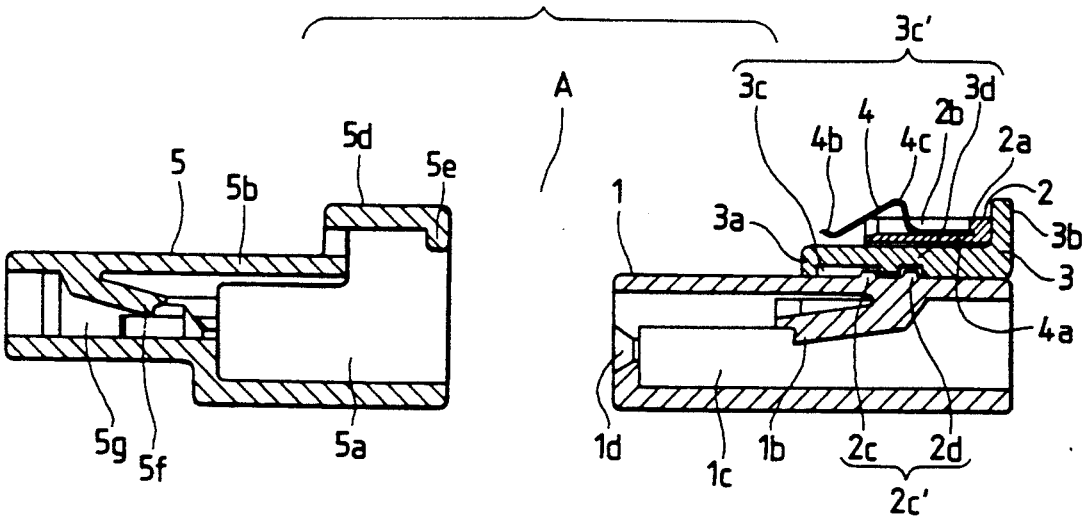
FIG. 2 is a longitudinal sectional view of the connector assembly A.

FIG. 1 is an exploded perspective view showing a connector assembly A with a connector housing locking mechanism according to the invention, and FIG. 2 is a longitudinal sectional view of the connector assembly A.

As shown in FIGS. 1 and 2, a guide frame 2 is mounted on the rear half of the upper wall 1*a* of a male electrical connector housing 1, and has an upper plate 2*a* with an opening 2*b*, and a slide piece 3 is slidably provided between the upper wall 1*a* and the upper plate 2*a*.

A locking spring 4 inverted-V-shaped in section (having a rise 4*c*) is mounted on the upper plate 2*a* of the guide frame 2. More specifically, one end portion 4*a* of the locking spring 4 is fixedly secured to the guide frame 2, and the other end portion 4*b* is bent on the same side as the rise 4*c* and is adjusted in length so that it is above the end portion 3*a* of the slide piece 3 when the slide piece 3 is at the forward position, and located ahead of the end portion 3*a* when the slide piece 3 is at the backward position.

The other end portion, opposite to the end portion 3*a*, of the slide piece 3 is formed into a knob 3*b*. First and second engaging recesses 3*c* and 3*d* forming an engaging section 3*c*' are formed in the inner surface of the slide piece 3, while first and second locking protrusions 2*c* and 2*d* forming a locking section 2*c*' are formed on the upper wall 1*a* of the male connector 1, in such a manner that they confront with the first and second engaging recesses 3*c* and 3*d*, respectively. That is, the second engaging recess 3*d* is engaged with the second locking protrusion 2*d*, while the first engaging recess 3*c* is so designed in length that it is engageable with both of the first and second locking protrusions 2*c* and 2*d* at the same time. The locking section 2*c*' and the engaging section 3*c*' form locking means for holding the slide piece 3 in position.

In the male connector housing 1, a plurality of terminal accommodating chambers 1*c* with flexible locking pieces 1*b* are formed. Insertion holes 1*d* are formed in the terminal accommodating chambers 1*c* at the front ends, to receive terminals (not shown) which have been inserted into a female electrical connector housing 5, respectively.

In the female connector housing 5, its upper wall 5*b* is raised at the open end to provide a raised portion 5*d*, thus forming a connector receiving section 5*a* which receives the mating male connector 1. A protrusion 5*e* is extended inwardly from the edge of the opening of the raised portion 5*d*. The protrusion 5*e* is used as a spring check against the locking spring 4.

The protrusion 5*e* is so designed that, when the male connector housing 1 is inserted into the female connector housing 5, the rise 4*c* of the locking spring of the male connector housing 1 is brought into slide contact with the end of the protrusion 5*e*.

In the rear end portion of the female connector housing, opposite to the front end portion having the connector receiving section 5*a*, a plurality of terminal accommodating chambers 5*g* with flexible locking pieces 5*f* are formed.

Figure 3:
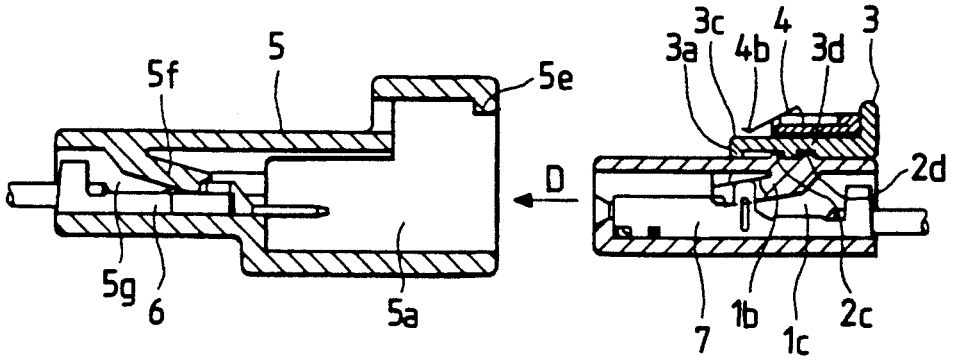
FIG. 3 is a longitudinal sectional view showing a pair of connectors which are going to be engaged with each other.

The connector assembly designed as described above is used as follows: Male terminals 6 are inserted into the terminal accommodating chambers 5*g* in the female connector housing 5, and fixedly secured with the flexible locking pieces 5*f*, while female terminals 7 are inserted into the terminal accommodating chambers 1*c* in the male connector housing 1, and fixedly secured with the flexible locking pieces 1*b*. Under this condition, as shown in FIG. 3 the male connector housing 1 is pushed in the direction D.

In this operation, the second locking protrusion 2*d* of the male connector housing 1 is engaged with the second engaging recess, 3*d* of the slide piece 3, while the first locking protrusion 2*c* is engaged with the first engaging recess 3*c*; that is, the slide piece 3 is moved forward with respect to the guide frame 2, so that the front end portion 4*b* of the locking spring 4 is located above the end portion 3*a* of the slide piece 3.

Figure 4A:
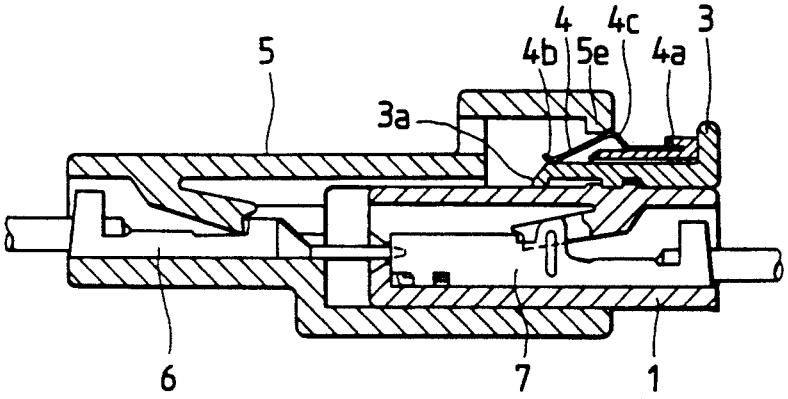
FIG. 4 (A) is a longitudinal sectional view showing the connectors which are in the first step of engagement.
Figure 4B:
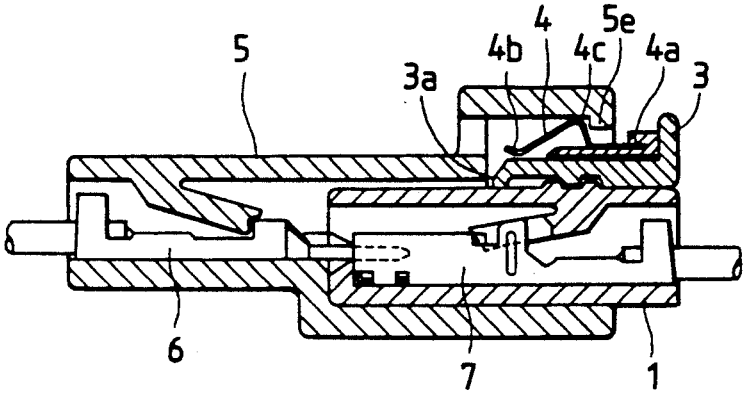

When the degree of engagement of the male and female connector housings 1 and 5 is increased as shown in FIG. 4 (A), then the protrusion 5*e* of the female connector housing 5 abuts against one slope of the rise 4*c* of the locking spring 4, while the front end portion 4*b* of the locking spring 4 abuts against the front end portion 3*a* of the slide piece 3, so that the locking spring 4 acts as a spring supported at two points, the two end portions 4*a* and 4*b*.

When the degree of engagement of the male and female connector housings is further increased, the protrusion 5*e* of the female connector housing 5 pushes down the rise 4*c* of the locking spring 4 of the male connector housing 1. When the degree of engagement of the male and female connectors housings is further increased, the locking spring acts as follows: That is, when the rise 4*c* of the locking spring 4 moves over the protrusion 5*e* of the female connector housing 5, a component of force in a direction of insertion/extraction of the connector, which is based on the force of repulsion of the locking spring provides, accelerates the insertion of the male connector housing 1.

This component of force is added to the manual insertion force, so that the male connector housing is engaged with the female connector housing at a stroke as shown in FIG. 4 (B). Thus, the insufficient engagement of the male and female connector housings is prevented according to the invention.

Figure 5:
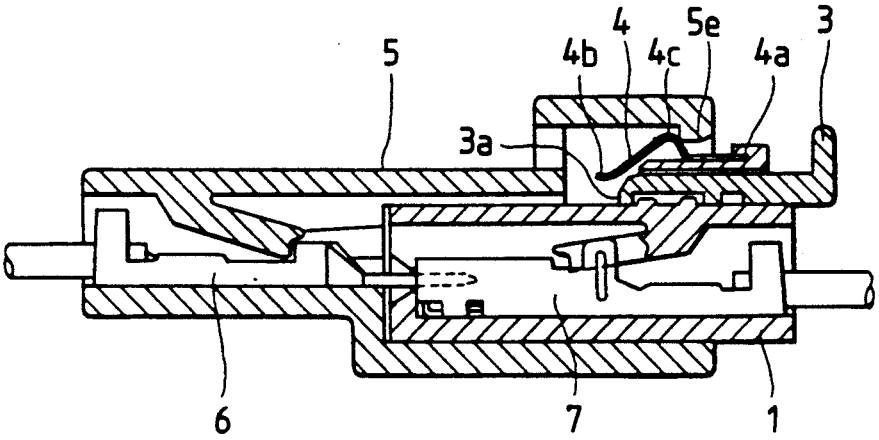
FIG. 5 is a longitudinal sectional view showing the connectors which are in the first step of disengagement.

The male and female connector housings are disengaged as follows: First, the slide piece 3 is pulled out (or moved backwardly) As a result, the first engaging recess 3*c* of the slide piece 3 is engaged with the first and second locking protrusions 2*c* and 2*d* as shown in FIG. 5; that is, the slide piece 3 is held at the backward position. At the same time, the front end portion 4*b* of the locking spring 4 is set in front of the end portion 3*a* of the slide piece 3; that is, the locking spring 4 is cantilevered at the end portion 4*a*.

When, under this condition, the male and female connector housings 1 and 5 are slightly disconnected from each other, the other slope of the rise 4*c* of the locking spring 4 which is on the side of the end portion 4*a* abuts against the protrusion 5*e* of the female connector housing 5. When the degree of disengagement of those connector housings is increased, the rise 4*c* of the locking spring 4 is pushed downwardly by the protrusion 5*e*. In this case, since the front end portion 4*b* of the locking spring 4 is set free, the locking spring 4 is readily displaced downwardly, thus scarcely interfering with the force of disengagement.

Figure 6A:
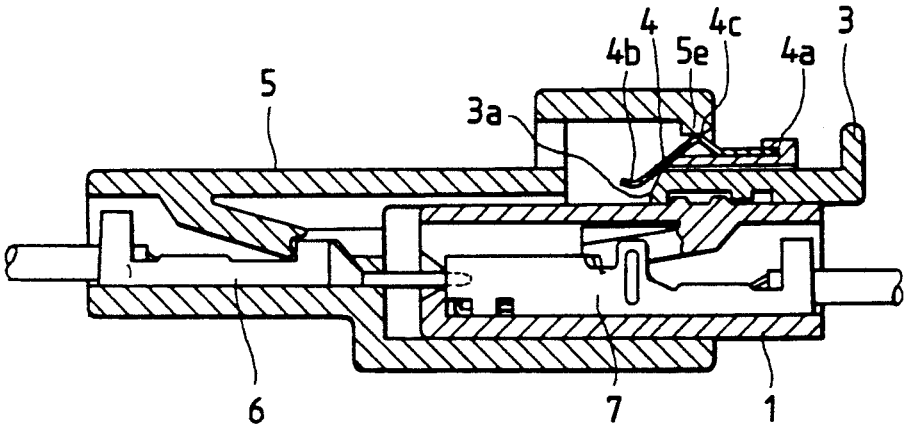
FIG. 6 (A) is a longitudinal sectional view showing the connectors which are in the second step of disengagement.
Figure 6B:
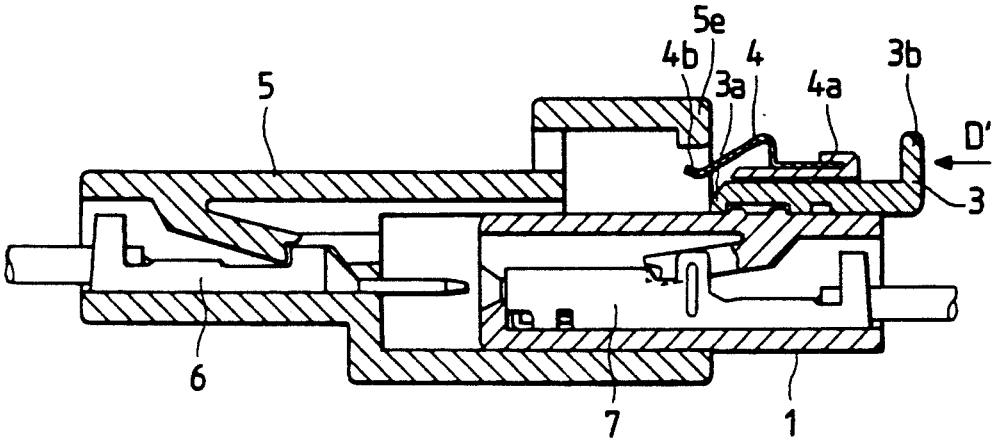
Figure 7A:
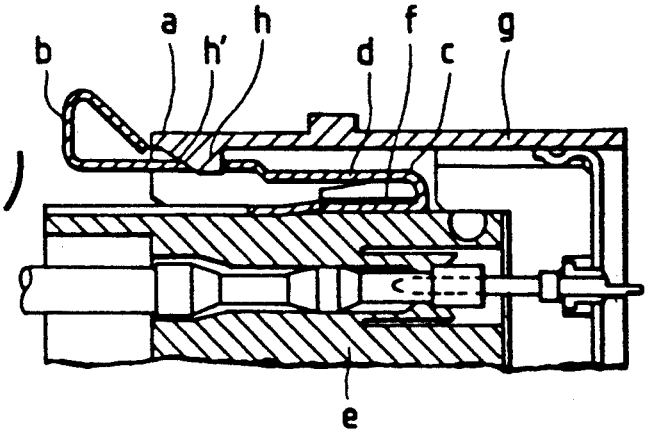
PRIOR ART FIG. 7(A)
FIG. 7 (A) is a sectional view showing essential components of a conventional connector assembly locking mechanism.
Figure 7B:
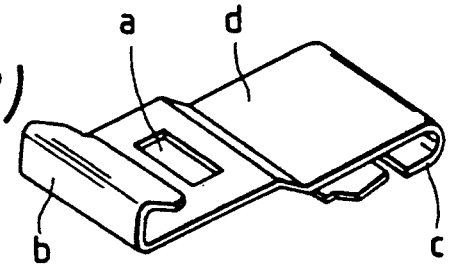
PRIOR ART FIG. 7(B)
Figure 8A:
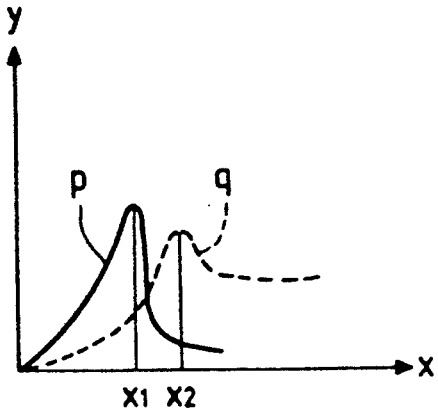
FIG. 8 (A) is a graphical representation indicating connector engaging strokes with housing locking forces and terminal engaging forces.
Figure 8B:
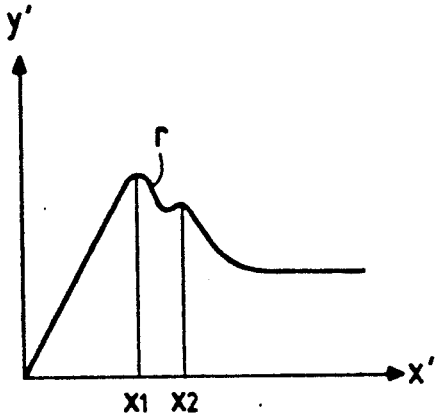

When the degree of disengagement of the connector housings is further increased, the rise 4*c* of the locking spring 4 slides on the end face of the protrusion 5*e* of the female connector housing 5 so as to be disengaged from it (cf. FIG. 6 (A)).

When the rise 4*c* of the locking spring 4 is disengaged from the end face of the protrusion 5*e* of the female connector housing 5, the component of force in a direction of insertion/extraction of the connector, which is based on the force of repulsion of the locking spring, acts in the direction of extraction of the male connector housing 1, so that the force applied for disengagement of the male connector housing from the female connector housing is abruptly reduced. Thus, the disengagement has been accomplished.

Upon completion of the disengagement of the male and female connector housings 1 and 5, the slide piece 3 is pushed in the direction D'; that is, it is set at the forward position so that the connector housings be ready for the next engagement.

That is, when the connector housings are engaged with each other, the slide piece 3 is held at the forward position so that the locking spring 4 serves as a spring supported at two points, thereby to prevent the insufficient engagement of the connector housings; and when the connector housings are disengaged from each other, the slide piece 3 is held at the backward position so that the locking spring serves as a cantilevered spring, whereby the connector housings can be disengaged from each other with ease. Thus, engagement and disengagement of the male and female connector housings can be achieved readily with high efficiency.

In the above-described embodiment, the protrusion 5*e* is used as the spring check against the locking spring 4. However, instead of the protrusion 5*e*, an engaging hole may be formed in the raised portion 5*d*, to check the locking spring 4.

As is apparent from the above description, the locking mechanism provided for connectors according to the invention through which electrical wires are connected, for instance, in an automobile prevents the connectors from being insufficiently engaged by inertial locking, and allows the connectors to be engaged or disengaged with ease.

What is claimed is:

1. A locking mechanism for a connector assembly comprising:

a pair of male and female electrical connectors each having terminals and being engaged with each other, a housing of one of said connectors having a connector receiving portion for receiving a housing of the other of said connectors a guide frame mounted on the outer wall of said housing of said other connector;

a locking spring substantially inverted-V-shaped in section provided with said guide frame, one end portion of said locking spring being fixedly secured to said guide frame;

a slide piece between said guide frame and said outer wall of said housing of said other connector, said slide piece being slidable in an axis of a connector insertion direction;

a locking member for holding said slide piece at a forward position and at a backward position, said locking member being provided between said slide piece and said outer wall of said housing of said other connector; and a spring receiving member for engaging with said locking spring, said spring receiving member being provided with said connector receiving portion, wherein when said slide piece is at said forward position, a free end of said locking spring is positioned above a front end portion of said slide piece, and when said slide piece is at said backward position, a free end of said locking spring is positioned in front of said front end portion of said slide piece.

2. A locking mechanism for a connector assembly as claimed in claim 1, wherein said spring receiving member is defined by a hole at said connector receiving portion.

* * * * *